United States Patent [19]

Kondo et al.

[11] 4,424,267

[45] Jan. 3, 1984

[54] ELECTROPHOTOGRAPHIC IMAGE HOLDING MEMBER

[75] Inventors: Hideyo Kondo, Toride; Naoto Fujimura, Abiko, both of Japan

[73] Assignee: Canon Kabushiki Kaisha, Tokyo, Japan

[21] Appl. No.: 362,251

[22] Filed: Mar. 26, 1982

Related U.S. Application Data

[63] Continuation of Ser. No. 182,069, Aug. 28, 1980, abandoned, which is a continuation of Ser. No. 948,237, Oct. 3, 1978, abandoned.

[30] Foreign Application Priority Data

Oct. 7, 1977 [JP] Japan ..... 52-120731
Oct. 7, 1977 [JP] Japan ..... 52-120732

[51] Int. Cl.[3] ..... G03G 7/00

[52] U.S. Cl. ..... 430/66; 430/126; 430/67; 428/492

[58] Field of Search ..... 430/60, 64, 66, 67, 430/126; 428/492

[56] References Cited

FOREIGN PATENT DOCUMENTS 52-123683 10/1977 Japan ..... 430/96

*Primary Examiner*—John E. Kittle
*Assistant Examiner*—John L. Goodrow
*Attorney, Agent, or Firm*—Fitzpatrick, Cella, Harper & Scinto

[57] ABSTRACT

An image-holding member for holding electrostatic images or toner images comprising a support and an image-holding layer contains a curable rubber layer.

10 Claims, No Drawings

ELECTROPHOTOGRAPHIC IMAGE HOLDING MEMBER

This is a continuation of application Ser. No. 182,069, filed Aug. 28, 1980 now abandoned which in turn is a continuation of Ser. No. 948,237, filed: Oct. 3, 1978 now abandoned.

BACKGROUND OF THE INVENTION

1. Field of the Invention

The present invention relates to an image-holding member for holding electrostatic images or toner images.

2. Description of the Prior Art

Electrostatic images or toner images may be formed by various processes. As the image-holding member on which electrostatic images or toner images are formed, there are electrophotographic photosensitive members having a photoconductive layer and image-holding members having no photoconductive layer.

Image-holding members usually comprise a support and an image-holding layer.

Structures of electrophotographic photosensitive members are different from one another depending upon desired properties of electrophotographic photosensitive members and electrophotographic processes for which the photosensitive member is used.

As typical photosensitive members, there are widely used a member having a photoconductive layer (as an image-holding layer) formed on a support and a photosensitive member having, as an image-holding layer, a laminate composed of an insulating layer and a photoconductive layer. The photosensitive member consisting of a support and photoconductive layer is employed in the image formation based on the most popular electrophotographic process which comprises the charging, image exposing and developing steps, and further transferring step if desired. As for the photosensitive member provided with an insulating layer, such layer is formed for the purpose of protecting the photoconductive layer, improving the mechanical strength of the photosensitive member, bettering the dark decay characteristic of the member, or adapting the member to a specified electrophotographic process. Typical photosensitive members having such an insulating layer or examples of the electrophotographic process using the member having an insulating layer are disclosed, for example, in U.S. Pat. No. 2,860,048, Japanese Patent Publication Nos. 16429/1966, 15446/1963, 3713/1971, 23910/1967, 24748/1968, 19747/1967, and 4121/1961.

To the electrophotographic photosensitive member, a predetermined electrophotographic process is applied so that an electrostatic image is formed, and then it is visualized by development.

Typical image-holding members excluding a photoconductive layer have an insulating layer as an image-holding layer. Some of such typical image-holding members will be given below:

(1) Image-holding member having no photoconductive layer used in the electrophotographic process which comprises forming an electrostatic image on a photosensitive member, transferring the image to the image-holding member having no photoconductive layer for the purpose of improving the repeating usability of the photosensitive member, developing the transferred image and transferring the toner image to a recording material. This process is disclosed, for example, in Japanese Patent Publication Nos. 7115/1957, 8204/1957 and 1559/1968.

(2) Image-holding member having no photoconductive layer used in the electrophotographic process which comprises forming an electrostatic image on an electrophotographic photosensitive member in a screen form having a large number of fine openings by the predetermined electrophotographic process, applying corona charging treatment to the image-holding member having no photoconductive layer through the electrostatic image to modulate the ion flow from the corona so that the electrostatic image is formed on the above mentioned image-holding member, developing such image with a toner, and transferring the toner image to a recording material thereby forming the final image. This process is disclosed, for example in Japanese Patent Publication Nos. 30320/1970 and 5063/1973, and Japanese Patent Laid Open No. 341/1976 as the electrophotograhic process in which an electrostatic image corresponding to that formed on the photosensitive member is formed on the image-holding member.

(3) Image-holding member having no photoconductive layer employed in the electrophotographic process which comprises forming a toner image on an electrophotographic photosensitive member, transferring the toner image to the image-holding member having no photoconductive layer without directly transferring it to a recording material, and then transferring the toner image from the image-holding member to a recording material followed by fixation. This process is effective, particularly for forming a color image and copying at a high speed. Most of the recording materials are usually flexible, such as for example paper and film. As a result, in case of transferring cyan, magenta and yellow images directly onto such a recording material, it is difficult to register exactly the positions of the images. On the contrary, if the cyan, magenta and yellow images are transferred onto the image-holding member which can be formed from a hardly deformable material with the positions of the images registered and the transferred image are further transferred onto the recording material, a color image in which the positions of the images are more exactly registered can be obtained on the recording member. In addition, it is also effective for high speed copying that a toner image is transferred to a recording material through the image-holding member.

(4) Image-holding member having no photoconductive layer employed in the electrophotographic process which comprises applying electric signal to the multistylus electrode to form an electrostatic image corresponding to the electric signal on the image-holding member having no photoconductive layer and developing the image. The image-holding members (1)–(4) do not require a photoconductive layer.

Image-holding members used for electrophotographic processes are subjected to various electrical and mechanical effects such as corona charging, development, cleaning and the like so that the image-holding members are often deteriorated and damaged. In addition, electric charge retentivity is apt to be lowered by influence of humidity. Once an image-holding member is damaged, the image quality formed on the image-holding member is markedly lowered. Therefore, it has been demanded to produce an image-holding member having excellent resistance to mechanical and electrical impacts and excellent electric charge retentivity. However, such desirable image-holding members have not yet been available.

SUMMARY OF THE INVENTION

An object of the present invention is to provide an image-holding member of excellent durability.

Another object of the present invention is to provide an image-holding member of high resistance to dielectric breakdown.

A further object of the present invention is to provide an image-holding member of excellent electric charge retentivity.

Still another object of the present invention is to provide an image-holding member capable of forming images of high contrast.

A still further object of the present invention is to provide an image-holding member of high humidity resistance.

Still another object of the present invention is to provide an image-holding member having well balanced desirable characteristics.

According to the present invention, there is provided an image-holding member for holding electrostatic images or toner images comprising a support and an image-holding layer which contains a curable rubber layer.

DESCRIPTION OF THE PREFERRED EMBODIMENTS

According to the present invention, the curable rubber layer serves to improve electrophotographic property such as image contrast, dielectric breakdown resistance, humidity resistance and electric charge retentivity of an image holding member, and these characteristics are well balanced.

In addition, the curable rubber layer has an excellent adhesiveness and thereby can strongly adhere the layers contacting to the both sides of the curable rubber layer each other. This serves to enhance durability of the image-holding member to a great extent.

Further, since the curable rubber layer after curing is insoluble in usual solvents, the curable rubber is not damaged when an insulating layer or photoconductive layer is formed by applying a coating solution or coating dispersion onto the curable rubber layer. Therefore, even if a layer covered with the curable rubber layer is of low solvent resistance, said layer can be completely protected by the curable layer and thereby, is free from damage.

Representative structures of the image-holding member according to the present invention are a structure comprising a curable rubber layer intermediate between an image-holding layer and a support and a structure comprising a support and an image-holding layer overlying the support and the curable rubber layer is present in the image-holding layer.

Examples of the former structure are a structure comprising a support, a curable rubber layer overlying the support, and a photoconductive layer overlying the curable rubber layer; a structure comprising the above mentioned structure and an insulating layer overlying the photoconductive layer; and a structure comprising a support, a curable rubber layer overlying the support and an insulating layer overlying the curable rubber layer.

In such image-holding members that have a curable rubber layer between an image-holding layer and a support, the adhesiveness between the image-holding layer and the support is enhanced to a great extent.

In the latter structure, when the image-holding layer is a laminate of plural layers, the curable rubber layer or layers may be inserted between the plural layers of the image-holding layer so as to increase adhesiveness between the layers.

Examples of image-holding members of the latter structure are an image-holding member comprising a support, a photoconductive layer overlying the support, a curable rubber layer overlying the photoconductive layer and a insulating layer overlying the curable rubber layer; and an image-holding member comprising a support, a photoconductive layer overlying the support, a first insulating layer overlying the photoconductive layer, a curable rubber layer overlying the first insulating layer, and a second insulating layer overlying the curable rubber layer.

Further, the curable rubber layer may be provided between a support and an image-holding layer and also in the image-holding layer. An embodiment of such structure is an image-holding member comprising a support, a curable rubber layer overlying the support, a photoconductive layer overlying the curable rubber layer, another curable rubber layer overlying the photoconductive layer, and an insulating layer overlying said another curable rubber layer.

The curable rubber used in the present invention is a rubber which is cured by energy such as heat, light, electron beam and the like. This curing is caused by the formation of crosslinking and three dimensional chemical structure, and thereby rubber elastic property is decreased.

The curable rubber is usually used in the cured form for the curable rubber layer of the image-holding member according to the present invention. However, a cyclized rubber may be used in the uncured form for the curable rubber layer.

As the curable rubber, commercially available curable rubber may be used. Representative curable rubbers are cyclized butadiene rubber, isoprene rubber, isobutylene-isoprene rubber, butyl rubber, butadiene rubber, butadiene-styrene rubber, nitrile rubber, chloroprene rubber, chlorinated polyethylene rubber, fluorine containing rubber, chlorosulfonated polyethylene rubber, and silicone rubber.

Cyclized rubbers are preferable. Cyclized rubber has a ring structure in the molecule. Representative cyclized rubbers are cyclized butadiene rubber, cyclized isoprene rubber, cyclized natural rubber, triazine rubber, and the like.

The curable rubber layer may be formed by a curable rubber alone or in combination with other resins.

Since the curable rubber layer composed of some curable rubber in the cured form may be etched by a particular solvent such as, for example, tetrahydrofuran, cyclohexane and the like. Therefore, the adhesion between the curable rubber layer and an insulating layer, a photoconductive layer or a support can be enhanced by treating the surface of the curable rubber layer with such solvent to form a rough surface and overlaying such other layer.

Thickness of the insulating layer is selected depending upon the desired characteristics. In general, when the insulating layer is provided for the purpose of protecting the image-holding member and improving the durability and the dark decay characteristic, thickness of the insulating layer is relatively thin. On the contrary, when the insulating layer is provided for the purpose of using the image-holding member for a particular electrophotographic process, thickness of the insulating layer is relatively thick. In general, thickness of the insulating layer is 0.1–100 microns, particularly, 0.1–50 microns.

The curable rubber layer is usually 0.1–30 microns in thickness, preferably, 1–20 microns in thickness.

The insulating layer may be formed by a resin optionally selected from various resins suitable for the purpose. Examples of resins used for the insulating layer are polyethylene, polyesters, polypropylene, polystyrene, polyvinyl chloride, polyvinyl acetate, acrylic resins, polycarbonates, silicone resins, fluorine containing resins, epoxy resins and the like.

As to formation of the insulating layer, the insulating layer is more easily produced by coating than by adhering a resin film. In addition, when a coating method is applied to a drum type image-holding member, a seamless insulating layer can be obtained. In connection with this, curable resins, i.e. resins capable of being cured by heat, light, electron beam and the like, are preferable as compared with other types of resins.

As to heat curing, some heat curable resin can be cured at room temperature.

Particularly preferable curable resins are acrylic resins, urethane resins, polyester resins, epoxy resins, melamine resins, silicone resins and the like.

As a material for the support, there may be used metal plates such as stainless steel, copper, aluminum, tin, and the like, paper, resin film and the like.

The photoconductive layer may be formed by vapor-depositing under vacuum inorganic photoconductive materials such as S, Se, PbO, alloys or intermetallic compounds containing S, Se, Te, As, Sb or the like. Sputtering may be employed to deposit a photoconductive material of a high melting point such as ZnO, CdS, CdSe, $TiO_2$ and the like on a support to produce a photoconductive layer.

Further, when a coating method is employed to form a photoconductive layer, there may be used the following materials: organic photoconductive materials such as polyvinylcarbazole, anthracene, phthalocyanine and the like; the organic photoconductive materials which are sensitized by a dye or Lewis acid; and the above mentioned organic photoconductive materials mixed with an insulating binder.

A mixture of an inorganic photoconductive material with an insulating binder may be used. As the insulating binder, various resins may be used.

Thickness of the photoconductive layer varies depending upon kind and characteristics of photoconductive material used, but is usually 5–100 microns, preferably 10–50 microns.

When the photoconductive layer is formed by vapor-deposition under vacuum or sputtering, the surface of the photoconductive layer is so smooth that a layer such as insulating layer formed on the smooth surface of the photoconductive layer easily peels off. However, if the curable rubber layer is provided between a photoconductive layer and an insulating layer, this undesirable peeling can be prevented.

When an image-holding member is used for an electrophotographic process where dry development is employed, frictional force between the image-holding member and the toner is so large that the surface layer of the image-holding member is apt to be peeled off, but when the curable rubber layer is employed in the image-holding member, such peeling can be effectively prevented.

Further, when the photoconductive layer is composed of photoconductor particles dispersed in an insulating binder, the surface of the photoconductive layer becomes porous and therefore, when an insulating layer is produced by coating, the solvent and resin often penetrate the insulating layer and adversely affect characteristics of the photoconductive layer, but the curable rubber layer formed on the photoconductive layers can effectively prevent such undesirable penetration.

The following examples are given for illustrating the present invention, but not for restricting the present invention.

EXAMPLE 1

On an aluminum cylinder was formed a layer of Se-Te alloy (Te: 15% by weight) in the thickness of 70 microns by vapor-deposition. The surface of the resulting photoconductive layer was washed with methyl ethyl ketone and then soaked in a bath containing cyclized butadiene rubber (trade name, "JSR-IC", supplied by Japan Synthetic Rubber Co., Ltd.) diluted to 20 cps. with toluene, and the cylinder was pulled up at a velocity of 4 cm./min., dried at 40° C. for 10 min. to produce a curable rubber layer of 10 microns in thickness, and the curable rubber layer thus produced was irradiated by a 4 Kw mercury lamp for 60 seconds to cure. Onto the curable rubber layer thus cured was formed an insulating layer of 25 microns in thickness by applying a light curable urethane resin (trade name, "SONNE", supplied by Kansai Paint Co., Ltd.) by a soaking method and was cured by light. The resulting sample is called sample (A).

Following the above procedure except that a urethane resin (tradename, "SONNE") layer was formed directly in the thickness of 35 microns directly on the photoconductive layer in place of forming the cyclized butadiene rubber layer on the photoconductive layer and then the urethane resin layer of 25 microns thick, there is obtained another sample, Sample (B).

(I) Sample (A) and Sample (B) were subjected to an electrophotographic process comprising a negative primary corona charging, a secondary AC corona discharging simultaneously with imagewise exposure, and a blanket exposure to produce electrostatic images. At 0.5 seconds after the blanket exposure, contrast of electrostatic images formed on Sample (A) was 750 V while that on Sample (B) was 600 V.

(II) Electrostatic images on Sample (A) and Sample (B) were developed and the developed images were transferred to each receiving paper. Then the electrostatic images were developed again and the developed images were transferred. In this way the developing and transferring steps were repeated 100 times. As the result, contrast of electrostatic images formed on Sample (A) decreased to 530 V, but the transferred images were almost as clear as those at the beginning. On the contrary, contrast of electrostatic images on Sample (B) remarkably decreased to 250 V and the transferred images were so thin and not clear.

(II) After Sample (A) and Sample (B) were allowed to stand in an atmosphere of 85% RH and 35° C. for 24 hours, these Samples were subjected to an electrophotographic process comprising a negative primary corona charging, a secondary AC corona discharging simultaneously with an imagewise exposure and a blanket exposure to produce electrostatic images. Contrast of electrostatic images formed on Sample (A) was 730 V and the developed images were sharp and clear. On the contrary, contrast of electrostatic images formed on Sample (B) was 450 V and the developed images were thin and not sharp.

(IV) Sample (A) and Sample (B) were subjected to an electrophotographic process comprising a negative primary corona charging, a secondary AC corona discharging simultaneously with an imagewise exposure, a blanket exposure, dry development, transferring the developed images to a receiving paper, and cleaning with a cleaning blade. When the process was repeated 1000 times, the images at the 1000th copying by Sample (A) were as clear and sharp as those at the beginning, but the images at the 1000th copying by Sample (B) contained small white spots (not developed portions) at a rate of 4 spots per 1500 sq. cm. These spots were formed by small protrusions (small protrusions are usually formed on the surface of a photoconductive layer when the photoconductive layer is produced by vapor-deposition) at which the insulating layer was subjected to dielectric breakdown.

(V) The above mentioned electrophotographic process was repeatedly applied to Sample (A) and Sample (B). When copying was repeated 30,000 times, images formed by Sample (A) were still good and any peeling of the surface layer of Sample (A) was no observed. On the contrary, when copying was repeated 800 times, a part of the surface layer of Sample (B) peeled off.

In the above example, when Sample (A') prepared by repeating the procedure for the preparation of Sample (A) except that the curable rubber layer was not cured, that is, irradiation by the mercury lamp was omitted, and the same tests as in (I)-(V) above were conducted, the results are as follows:

(I)—720 V
(II)—480 V
(III)—650 V
(IV)—one spot per 1500 sq.cm.
(V)—more than 15,000 copies

EXAMPLE 2

On an aluminum cylinder was formed an Se layer in the thickness of 60 microns by vapor-deposition. The surface of the Se layer was washed with methyl ethyl ketone. Cyclized butadiene rubber (trade name, "CLBR", supplied by Japan Synthetic Rubber Co., Ltd.) was diluted to 20 cps. with toluene. The Se layer was soaked in the cyclized butadiene rubber bath as prepared above and then pulled up at a speed of 4 cm./min., dried at 40° C. for 10 min. to form the curable rubber layer of 15 microns in thickness, and irradiated by a 4 Kw mercury lamp for 60 sec. to cure it. Then a solution of a light curable polyester resin (trade name, "M-60", supplied by Kansai Paint Co., Ltd.) was applied to the cured rubber layer, dried and irradiated by a high pressure mercury lamp for 3 min. to cure the polyester to form an insulating layer of 10 microns in thickness. The resulting sample is hereinafter referred to as Sample (A).

Repeating the above-mentioned procedures except that the light curing by the 4 Kw mercury lamp was not applied to the curable rubber layer, there was obtained another sample. This sample is hereinafter referred to as Sample (A').

A further sample prepared by repeating the procedures for the preparation of Sample (A) above except that the cyclized butadiene rubber layer (a curable rubber layer) was omitted and the light cured polyester resin (an insulating layer) was formed in the thickness of 25 microns directly on the Se layer. This sample is hereinafter called Sample (B).

The tests (I)-(V) as in Example 1 were conducted with respect to Sample (A), Sample (A') and Sample (B). The results are shown below.

| | Sample (A) | Sample (A') | Sample (B) |
|---|---|---|---|
| I | 740 V | 670 V | 580 V |
| II | 520 V | 450 V | 230 V |
| III | 700 V | 610 V | 270 V |
| IV | none/1500 sq. cm. | none/1500 sq. cm. | 5 spots/1500 sq. cm. |
| V | more than 35,000 copies | more than 22,000 copies | 2,000 copies |

Folllwing the above mentioned procedures using other curable cyclized rubbers, the following Samples (C), (E), (G) and (I) were produced. These Samples show electric charge retentivity, humidity resistance and durability almost as good as those of Sample (A).

Further, in the similar way, the following Samples (D), (F) and (H) were produced. These Samples show the above mentioned characteristics almost as good as those of Sample (A').

Sample (C)

Support: Al cylinder
Photoconductive layer:
Se-Te (Te, 10% by weight)
(60 microns in thickness)
Curable rubber layer:
Curable cyclized isoprene rubber (tradename, "Kodak Thin Film Resist KTFR", supplied by Kodak)
(10 microns in thickness)
(Curing conditions: Irradiation by a high pressure mercury lamp for 5 min.)
Insulating layer:
Epoxy resin (tradename, "Epikote", supplied by Shell Chemical Co., Ltd.)
(15 microns in thickness)

Sample (D)

Support: Al cylinder
Photoconductive layer:
Se-Te (Te: 10% by weight)
(60 microns in thickness)
Curable rubber layer:
Curable cyclized isoprene rubber (tradename, "Kodak Thin Film Resist KTFR", supplied by Kodak)
(10 microns in thickness)
(no curing treatment)
Insulating layer:
Epoxy resin (tradename, "Epikote", supplied by Shell Chemical Co., Ltd.)
(15 microns in thickness)

Sample (E)

Support: Al cylinder
Photoconductive layer: CdS (40 microns in thickness)
Curable rubber layer:
Curable cyclized polyisoprene rubber (tradename, "OMR", supplied by Tokyo Ohka Kogyo Co., Ltd.)

(8 microns in thickness)
(Curing conditions: 150° C., 30 min.)
Insulating layer:
Acrylic resin (tradename, "Pulslac No. 2000", supplied by Chugoku Marine Paints Co., Ltd.)
(20 microns in thickness)

Sample (F)

Support: Al cylinder
Photoconductive layer: CdS (40 microns in thickness)
Curable rubber layer:
Curable cyclized polyisoprene rubber (tradename, "OMR")
(8 microns in thickness)
(No curing treatment)
Insulating layer:
Acrylic resin (tradename, "Pulslac No. 2000")
(20 microns in thickness)

Sample (G)

Support: Al cylinder
Photoconductive layer: CdS (40 microns in thickness)
Curable rubber layer:
Curable cyclized natural rubber (tradename, "Fuji Super Resist FSR", supplied by Fuji Chemicals Industrial Co., Ltd.)
(15 microns in thickness)
(Curing conditions: 180° C., 20 min.)
Insulating layer:
Silicone resin (tradename, "X-12-917", supplied by Shinetsu Silicone)
(10 microns in thickness)

Sample (H)

Support: Al cylinder
Photoconductive layer: CdS (40 microns in thickness)
Curable rubber layer:
Curable cyclized natural rubber (tradename, "Fuji Super Resist")
(15 microns in thickness)
(No curing treatment)
Insulating layer:
Silicone resin (tradename, "X-12-917")
(10 microns in thickness)

Sample (I)

Support: Al cylinder
Photoconductive layer: CdS (45 microns in thickness)
Curable rubber layer:
Curable cyclized natural rubber (tradename, "Alpex CK 450", supplied by Hoechst Co., Ltd.)
(7 microns in thickness)
(Curing conditions: 160° C., 30 min.)
Insulating layer: Urethane resin (tradename, "Toa Urethane", supplied by Toa Urethane Co., Ltd.)

Samples shown in the following Examples 3–7 also showed improvements in electric charge retentivity, humidity resistance, and durability by using a curable rubber layer.

EXAMPLE 3

Support: Al cylinder
Photoconductive layer: Vapor-deposited Se-Te-As (Te, 10% by weight; As 1.0% by weight; 65 microns in thickness)
Curable rubber layer:
Curable urethane rubber (tradename, "nipporane", supplied by Nippon Polyurethane Industry Co., Ltd.)
(1.5 microns in thickness)
(Curing conditions: 80° C., 30 min.)
Insulating layer: Acrylic resin (tradename, "Pulslac No. 2000", supplied by Chugoku Marine Paints Co., Ltd.) (25 microns in thickness)

EXAMPLE 4

Support: Al cylinder
Photoconductive layer: ZnO (48 microns in thickness)
Curable rubber layer:
Curable styrene-butadiene rubber (tradename, "DIPOL", supplied by Mitsubishi Chemical Industries Limited)
(1.5 microns in thickness)
(Curing conditions: 120° C., 40 min.)
Insulating layer:
Epoxy resin (tradename, "Epikote", supplied by Shell Chemical Co., Ltd.)
(25 microns in thickness)

EXAMPLE 5

Similar to Example 4 above except that the curable rubber and the epoxy resin for the insulating layer (5:95) were mixed and applied directly to the surface of the photoconductive layer followed by heating at 40° C. for one hour to form a curable rubber layer.

EXAMPLE 6

Support: Al cylinder
Photoconductive layer: CdS vapor-deposited layer (45 microns in thickness)
Curable rubber layer:
Curable nitrile-butadiene rubber (tradename, "NIPOL", supplied by Nippon Zeon Co., Ltd.)
(1.5 microns in thickness)
(Curing conditions: 110° C., 30 min.)
Insulating layer:
Urethane resin (tradename, "Toa Urethane", supplied by Toa Urethane)
(25 microns in thickness)

EXAMPLE 7

Support: Al cylinder
Photoconductive layer: CdS (60 microns in thickness)
Curable rubber layer:
Curable fluorine containing rubber (tradename, "Viton", supplied by Du Pont)
(1.5 microns in thickness)
(Curing conditions: 120° C., 30 min.)
Insulating layer:
Melamine resin (tradename, "O-100-2", supplied by Nippon Paint Co., Ltd.)
(25 microns in thickness)

EXAMPLE 8

To a polyester film (25 microns in thickness) was applied a cyclized butaidene rubber (tradename, "JST-IC") layer in the thickness of 1.0 micron with a knife coater and then the curable rubber layer was dried and cured. To the curable rubber layer thus cured was applied a urethane-polyester resin (tradename, "CA 101" supplied by Nippon Oils & Fats Co., Ltd.) layer in the thickness of 5 microns. The resulting film was adhered to a CdS photoconductive layer (10% by weight of CdS particles dispersed in 90% by weight of a vinyl chloride-vinyl acetate copolymer resin) with an epoxy adhesive by facing the surface of the urethane-polyester resin layer to the CdS photoconductive layer to produce a photosensitive member. The resulting photosensitive member is hereinafter called Sample (C).

Another Sample was prepared by repeating the above-mentioned procedures for the preparation of Sample (C) except that the curable rubber layer was omitted and the thickness of the urethane-polyester resin layer was 6 microns. The resulting photosensitive member is called Sample (D).

Sample (C) and Sample (D) were subjected to an electrophotographic process comprising a positive primary corona charging, a secondary AC corona discharging simultaneously with imagewise exposure, and a blanket exposure to produce electrostatic images.

At 0.5 seconds after the blanket exposure, contrast of electrostatic images formed on each of Sample (C) and Sample (D) was about 700 V.

After Sample (C) and Sample (D) were allowed to stand in an atmosphere of 35° C. and 85% RH for 24 hours, these Samples were subjected to an electrophotographic process comprising a positive primary corona charging, a secondary corona discharging simultaneously with an imagewise exposure, and a blanket exposure to produce electrostatic images.

Contrast of electrostatic latent images formed on Sample (C) was 680 V. Contrast was hardly lowered. On the contrary, contrast of electrostatic images formed on Sample (D) was as low as 600 V.

Sample (C) and Sample (D) were subjected to an electrophotographic process comprising a positive primary corona charging, a secondary AC corona discharging simultaneously with an imagewise exposure, a blanket exposure, dry development, transferring the developed images to a receiving paper, and cleaning with a cleaning blade. Durability of these Samples was tested by applying the above mentioned electrophotographic process repeatedly. When copying was repeated 20,000 times, images formed by Sample (C) were still good and any peeling on the surface layer of Sample (C) was not observed. On the contrary, when copying was repeated 2000 times, a part of the surface layer of Sample (D) peeled off.

EXAMPLE 9

To an aluminum cylinder was applied a cyclized butadiene rubber (tradename, "CLBR") and cured by light to form an undercoating layer of 10 microns in thickness, and a silicone resin (tradename, "X-12-917", supplied by Shinetsu Kagaku Co., Ltd.) was applied onto the undercoating layer and cured by heating at 80° C. for 30 min. to form an insulating layer. The resulting cylinder is called "(X)".

To an aluminum cylinder support was directly applied a silicone resin layer. The resulting cylinder is called "(Y)".

(X) and (Y) were used as an electrostatic charge holding member, and a corona discharging was conducted. This corona discharging is modulated by electrostatic images formed on a CdS screen photosensitive member to produce electrostatic images on (X) and (Y). Contrast of electrostatic images on (X) was 350 V while that on (Y) was 320 V.

After (X) and (Y) were allowed to stand in an atmosphere of 35° C. and 85% RH for 24 hours, electrostatic images were formed thereon in a way similar to the above procedure. Contrast of electrostatic images on (X) was 330 V and the developed images were still sharp and clear. On the contrary, contrast of electrostatic images on (Y) was 190 V and the developed images were thin and not sharp.

In a process for producing electrostatic images on (X) or (Y) comprising corona discharging modulated by electrostatic images formed on a CdS screen photosensitive member, positive developer and a cleaning blade were used to conduct a durability test for development, transferring and cleaning. As the result, no damage was observed with respect to (X) even when the copying was repeated 55,000 times. On the contrary, the insulating layer of (Y) peeled off when copying was repeated 13,000 times.

The process for measuring electrostatic contrast of each sample and other characteristics by using a CdS screen photosensitive member was as shown below.

To a stainless steel wire net (opening width of about 50 microns) was attached a photoconductive layer in the thickness of 30 microns by a spray coating. Composition of the photoconductive layer was 70 parts by weight of CdS particles and 30 parts by weight of a silicone resin (tradename, "KR-255", supplied by Shinetsu Kagaku Co., Ltd.) and this composition was dried at 80° C. for 15 min. An insulating layer of 15 microns in thickness was formed on the photoconductive layer by a spray coating. The insulating layer was formed by a silicone resin (tradename, "TSR-144", supplied by Toshiba Silicone Co., Ltd.) containing a curing agent (tradename, "CR-15").

The surface of the resulting screen photosensitive member was subjected to charging to +450 V, imagewise exposure simultaneously with AC discharging to produce electrostatic images of −50 V at the light portions and +200 V at the dark portions, and then the cylinder was disposed over the stainless steel wire net side of the screen photosensitive member without contacting, and a negative corona discharging was applied through the screen photosensitive member. The resulting electrostatic images formed on the cylinder were developed with a dry toner, transferred to a receiving paper by an impressed voltage for transferring of about −6 KV and fixed to give visible images.

EXAMPLE 10

100 parts by weight of an activated photoconductive cadmium sulfide, 10 parts by weight (as solid matter) of vinyl chloride-vinyl acetate copolymer varnish (tradename, "V-1", supplied by Morikawa Ink Co., Ltd.), and 5 parts by weight of methyl isobutyl ketone (a diluting agent) were mixed and dispersed sufficiently by a roll-mill to prepare a paste of the photoconductive composition. The composition was diluted with methyl ethyl ketone to make a viscosity of 500–600 cps. In the resulting composition solution was dipped an aluminum cylinder, pulled up at a speed of 30 cm./min., and dried at 70° C. for 20 min. to evaporate the solvent completely. As the result, a photoconductive layer of 35 microns in thickness was formed.

The resulting cylinder was then dipped in a cyclized butadiene rubber (tradename, "JSR-IC") of 70 cps., pulled up at a speed of about 2 cm./min. and the curable rubber layer thus formed on the photosensitive layer was cured by light in the thickness of 3 microns.

The resulting cylinder was further dipped in a solution (100 cps.) of a light curable type acrylated urethane (tradename, "Sonne CK-4", supplied by Kansai Paint Co., Ltd.) in ethyl alcohol, pulled up at a speed of 4 cm./min. to form a thin film of the acrylated urethane on the cyclized butadiene rubber layer, and irradiated by ultraviolet ray in the UV irradiation apparatus for 120 sec. to cure. This coating procedure was repeated 3 times to form an insulating layer of 30 microns in thickness. The resulting photosensitive member had durability as excellent as that of Sample (A) of Example 1.

EXAMPLE 11

An aluminum cylinder was coated with a solution of a cyclized butadiene rubber (tradename: "JSR-IC", supplied by Japan Synthetic Rubber Co., Ltd.) in toluene by soaking, followed by baking at 180° C. for 20 min. to form the layer of 1 micron in thickness.

On the resulting layer was formed a photoconductive layer of 70 microns in thickness by vapor-depositing an Se-Te alloy (Te, 15% by weight). This sample is called Sample (A).

Further a sample consisting of a photoconductive layer of Se-Te directly formed on an aluminum cylinder was prepared. This is called Sample (B).

Sample (A) and Sample (B) were subjected to charging and imagewise exposure to produce electrostatic images. Contrast of electrostatic images formed on Sample (A) was 590 V and that on Sample (B) was 600 V. As far as contrast of electrostatic images, there is not a substantial difference between Sample (A) and Sample (B).

Sample (A) and Sample (B) were subjected to charging, imagewise exposure, development, transferring and cleaning (fur brush) and this process was repeatedly applied to Sample (A) and Sample (B). Even when the process was repeated 20,000 times, the resulting images produced by Sample (A) and the photoconductive layer of Sample (A) were still were not deteriorated. However, there were found cracks and swelling near the separating belt (a part of paper transferring mechanism) in case of Sample (B).

When subjected to a crosshatch test (by using an adhesive tape supplied by Sekisui Chemical Co., Ltd.), Sample (A) did not form peeling at a rate of 100/100, but Sample (B) peeled easily.

EXAMPLE 12

Repeating the procedures of Example 11 except that a styrene-butadiene rubber (tradename, "DIPOL", supplied by Mitsubishi Chemical Industries Limited) was used in place of cyclized butadiene rubber, a coating of 0.5 microns in thickness was formed by a spray method, and heated at 120° C. for 15 min. The resulting photosensitive member showed excellent durability.

EXAMPLE 13

Urethane rubber (tradename, "Nipporane", supplied by Nippon Polyurethane Industry Co., Ltd.) was coated on an aluminum cylinder in the thickness of 1 micron and cured by heating at 160° C. for 30 min. A CdS photoconductive layer (silicone resin as a binder resin; weight ratio of the binder resin to CdS particles being 35:100) was coated thereon and heated at 150° C. for 1 hour. Further on the resulting photoconductive layer was coated a light curable type urethane resin (tradename, "Sonne", supplied by Kansai Paint Co., Ltd.) and cured by irradiating with a high pressure mercury lamp for 3 seconds to form an insulating layer of 30 microns in thickness. The photosensitive member thus produced is called Sample (A).

Further, a sample consisting of a photoconductive layer of CdS formed directly on an aluminum drum having an insulating layer overlying the photoconductive layer, was prepared, as above. This sample is called Sample (B).

Sample (A) and Sample (B) were subjected to an electrophotographic process comprising a positive primary charging, secondary AC discharging simultaneously with imagewise exposure, a blanket exposure, a liquid development, and cleaning with a blade. Durability of the samples was tested by applying this process repeatedly.

No trouble was observed at all in Sample (A) even when the process was repeated 50,000 times while some swelling and partial peeling were observed in Sample (B). The result of crosshatch test was 100/100 for Sample (A) while it was 20/100–30/100 for Sample (B).

EXAMPLE 14

A cyclized butadiene rubber (tradename, "CLBR", supplied by Japan Synthetic Rubber Co., Ltd.) was coated on a nickel drum, irradiated with a super high pressure mercury lamp for 60 sec. to cure and produce the layer of 0.2 microns in thickness.

On the resulting layer was formed an Se-As (As, 0.5% by weight) photoconductive layer (40 microns in thickness) by vapor-deposition. A cyclized butadiene rubber (tradename, "CLBR") was applied to the resulting photoconductive layer, irradiated with a super high mercury lamp for 60 sec. to form a layer of 2 microns in thickness. Further, on this layer was coated a light curable acrylic resin (tradename, "Aronix 8060", supplied by Toagosei Chemical Industry Co., Ltd.) and irradiated with a high pressure mercury lamp for 5 seconds to form an insulating layer of 15 microns in thickness. The resulting sample is called Sample (A).

The above mentioned procedures were repeated except that the photoconductive layer was formed directly on the nickel drum in place of providing the cyclized butadiene rubber layer between the nickel drum and the photoconductive layer and the insulating layer was formed directly on the photoconductive layer in place of disposing the cyclized butadiene rubber layer between the photoconductive layer and the insulating layer. The resulting photosensitive member is called Sample (B).

Sample (A) and Sample (B) were subjected to the electrophotographic process of Example 13 except that the primary charging was negative charging in place of positive charging. When the process was applied to Sample (A) 200,000 times, no damage was observed. On the contrary, when the process was applied to Sample (B) 20,000 times, there was observed some peelings at the insulating layer or the photoconductive layer.

EXAMPLE 15

Repeating the procedures of Example 14 except that polyisoprene rubber (tradename, "Kuraprene", supplied by Kuraray Co., Ltd.) was disposed between the nickel drum and the photoconductive layer in place of cyclized butadiene rubber and isoprene rubber (tradename, "EPPR", supplied by Tokyo Ohka Kogyo, Co., Ltd.) was disposed between the photoconductive layer and the insulating layer in place of cyclized butadiene rubber and these curable rubber layers were cured by a super high pressure mercury lamp for 90 sec. in place of 60 sec., there was obtained a photosensitive member which showed excellent durability.

What we claim is:

1. An image-holding member for electrophotography for holding electrostatic images for both electrostatic and toner images comprising: (a) a support, (b) an image-holding layer, and (c) a cured curable rubber layer of cyclized rubber spaced between (a) and (b) or as a separate layer in (b) or both.

2. An image-holding member according to claim 1 in which the curable rubber layer is present between the support and the image-holding layer.

3. An image-holding member according to claim 2 in which the image-holding layer is a photoconductive layer.

4. An image-holding member according to claim 2 in which the image-holding layer is an insulating layer.

5. An image-holding member according to claim 2 in which the image-holding layer is a laminate composed of an insulating layer and a photoconductive layer.

6. An image-holding member according to claim 1 in which the curable rubber layer is provided in the image-holding layer.

7. An image-holding member according to claim 6 in which the image-holding layer comprises an insulating layer and a photoconductive layer and the curable rubber layer is present between the insulating layer and the photoconductive layer.

8. An image-holding member according to claim 1 in which the cyclized rubber is selected from the group consisting of cyclized polybutadiene rubber, cyclized isoprene rubber, cyclized natural rubber, and triazine rubber.

9. An image-holding member according to claim 1 in which the curable rubber layer is 0.1–30 microns in thickness.

10. An image-holding member according to claim 1 wherein said image-holding member comprises a support, a first cured curable rubber layer of cyclized rubber, a photoconductive layer overlying said first cured curable rubber layer of cyclized rubber, a second cured curable rubber layer of cyclized rubber, and an insulating layer overlying said second cured curable rubber layer of cyclized rubber.

* * * * *